US007478950B2

(12) United States Patent
Plourde et al.

(10) Patent No.: US 7,478,950 B2
(45) Date of Patent: Jan. 20, 2009

(54) VARIABLE ALIGNMENT SLIDER ZIPPER FOR RECLOSABLE BAGS

(75) Inventors: Eric P. Plourde, Frankfort, IL (US); Kevin P. Olechowski, Bourbonnais, IL (US)

(73) Assignee: Illinois Tool Works Inc., Glenview, IL (US)

( * ) Notice: Subject to any disclaimer, the term of this patent is extended or adjusted under 35 U.S.C. 154(b) by 262 days.

(21) Appl. No.: 11/315,689

(22) Filed: Dec. 22, 2005

(65) Prior Publication Data

US 2006/0090308 A1 May 4, 2006

Related U.S. Application Data

(63) Continuation-in-part of application No. 09/998,502, filed on Nov. 30, 2001, now abandoned.

(51) Int. Cl.
*B65D 33/24* (2006.01)
*B65D 33/34* (2006.01)
*A44B 19/16* (2006.01)

(52) U.S. Cl. ..... 383/5; 24/30.5 R; 24/399; 24/400; 24/585.12; 383/64; 383/204; 383/61.2

(58) Field of Classification Search ..... 24/400, 24/404, 389, 403, 30.5 P, 30.5 R, 585.12, 24/577, DIG. 40, 402, 415, 580.1, 590.1, 24/585.1; 383/5, 64, 203, 204, 207, 208, 383/209, 61.2, 61.3
See application file for complete search history.

(56) References Cited

U.S. PATENT DOCUMENTS

| | | | | | |
|---|---|---|---|---|---|
| 5,211,481 | A * | 5/1993 | Tilman | 383/63 |
| 5,238,306 | A * | 8/1993 | Heintz et al. | 383/210.1 |
| 5,368,394 | A * | 11/1994 | Scott et al. | 383/63 |
| 5,372,428 | A * | 12/1994 | Bruno et al. | 383/5 |
| 5,492,411 | A * | 2/1996 | May | 383/5 |
| 5,794,315 | A * | 8/1998 | Crabtree et al. | 24/589.1 |
| 6,217,215 | B1 * | 4/2001 | Tomic | 383/63 |
| 6,273,607 | B1 * | 8/2001 | Buchman | 383/5 |
| 6,915,546 | B2 * | 7/2005 | Kasai | 24/30.5 R |

* cited by examiner

*Primary Examiner*—Robert J Sandy
(74) *Attorney, Agent, or Firm*—Day Pitney LLP

(57) ABSTRACT

A reclosable slider zipper is disclosed wherein the profiles have several interlocking ribs thereby allowing the profiles to be interlocked in various alignments. A slider is provided to open and close the reclosable slider zipper. This results in increased reliability in alignment of the profiles during manufacturing processes and similarly results in increased smoothness and tactile feel for the consumer.

20 Claims, 9 Drawing Sheets

VARIABLE ALIGNMENT SLIDER ZIPPER FOR RECLOSABLE BAGS

This application is a continuation-in-part of application Ser. No. 09/998,502, filed Nov. 30, 2001, now abandoned entitled "Variable Alignment Zipper for Reclosable Bags", the contents of which are hereby incorporated by reference.

BACKGROUND OF THE INVENTION

1. Field of the Invention

This invention pertains to a slider zipper with variable alignment interlocking profiles. This invention further pertains to a reclosable bag formed with such a slider zipper.

2. Description of the Prior Art

The prior art for zippers with interlocking profiles is fairly well developed but nevertheless remains open to improvements, specifically those which contribute to an ease of use. For example, U.S. Pat. No. 4,787,880 entitled "Method of Making Extruded Zipper Strips and Bags Containing the Same", issued on Nov. 29, 1988 to Ausnit and U.S. Pat. No. 6,217,215 entitled "Closure Mechanism Having a Perceptible Feedback Feel", issued on Apr. 17, 2001 to Tomic disclose multiple interlocking ribs on both zipper profiles. A limitation on the use of multiple interlocking ribs is the opening and closing emphasis of the zipper. In an operation with two or more interlocking ribs, the higher force needed to open or close the zipper could indicate to the user that the zipper is being damaged.

These prior art references, along with the parent of the present application, have taught zippers wherein the profiles with multiple elements allow multiple configurations wherein alignment can be achieved. Additionally, in the parent application, a balanced tactile feel and increased smoothness of operation are achieved. However, while the prior art of slider zippers is well developed and has proven generally satisfactory for its intended use, improvements are sought in the art of slider zippers wherein the slider zippers could operate more smoothly with a reduced tendency to bind during operation.

Similarly, some manufacturing processes, such as a form fill and seal operation, require that the zipper profiles be separated prior to the insertion of a slider, with the zipper profiles being realigned in order to be returned to the interlocked position. Again, while this prior art has been well developed and has proven generally satisfactory for its intended use, further improvements are sought in the art of slider zippers so that this realignment, or similar alignment processes during manufacture, can become even more reliable and therefore contribute to the ability to operate at even higher speeds.

OBJECTS AND SUMMARY OF THE INVENTION

It is therefore an object of the present invention to provide improvements in slider zippers for reclosable bags, wherein the smoothness of operation is increased.

It is therefore a further object of the present invention to provide improvements in slider zippers for reclosable bags, which will allow for ease of alignment or realignment of zipper profiles during manufacturing processes, such as, but not limited to, form fill and seal processes.

These and other objects are attained by providing a zipper with a slider and interlocking profiles wherein the male interlocking profile of the zipper has a plurality of male ribs, typically three male ribs, each with a double-barbed end section. The male interlocking profile is interlockable with a female interlocking profile. The female interlocking profile has a plurality of male ribs, typically three male ribs, which form grooves or sockets for engaging the male interlocking profile. The bordering ribs of the female interlocking profile are each shaped with a single-barbed end section facing inward toward a middle male rib formed with a double-barbed end section.

Alternative embodiments can include a first profile which includes one or more ribs and a second profile which includes a plurality of grooves or sockets whereby the first profile can engage the second profile in a plurality of possible alignments.

By varying the engagement of the male and female interlocking profiles, the zipper can align in any one of a plurality positions for closure. These various alignments provide a balanced tactile feel to the user during an opening or closing of the zipper, even with the use of a slider. Additionally, this variable alignment capability makes the alignment or realignment of the zipper profiles more reliable during various manufacturing process steps, such as in a form fill and seal process.

DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
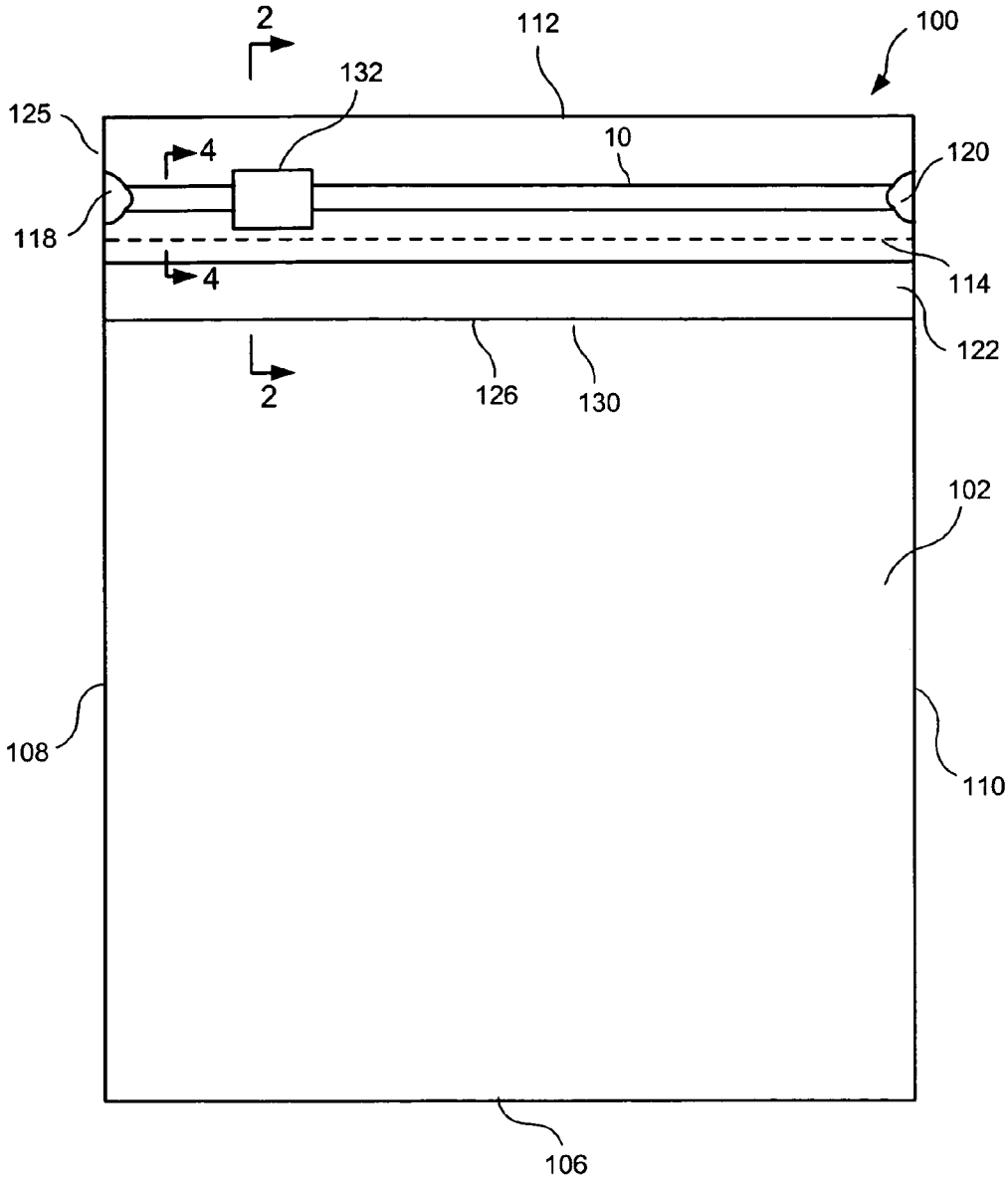
FIG. 1 is a plan view of a reclosable bag using the zipper of the present invention.
Figure 2:
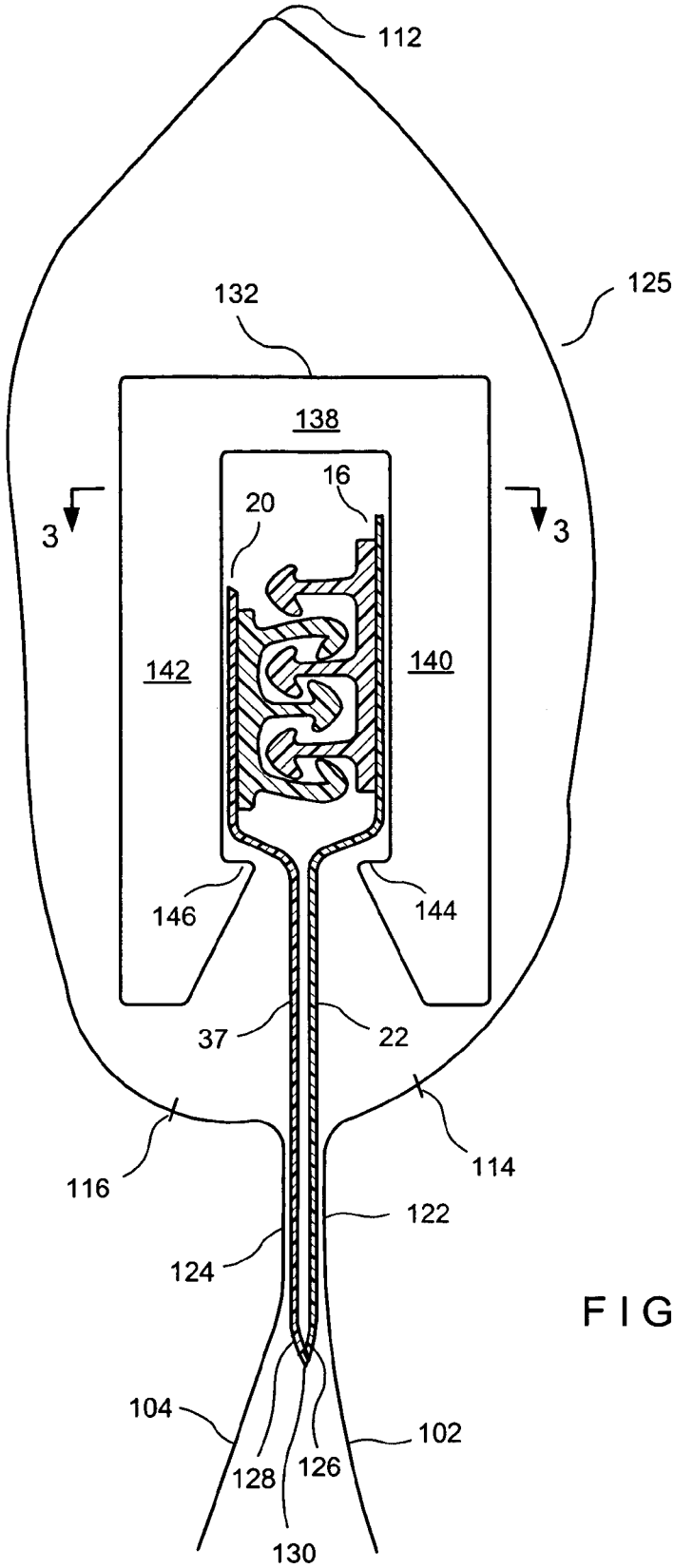
FIG. 2 is a cross-sectional view along plane 2-2 of FIG. 1.

Referring now to the drawings in detail wherein like numerals indicate like elements throughout the several views, one sees that FIG. 1 is a plan view of a typical reclosable bag 100 which employs variable alignment slider zipper 10 of the present invention. As shown in FIG. 1, along with the cross-sectional view of FIG. 2, reclosable bag 100 includes front web sheet 102 and rear web sheet 104. Typically, front and rear web sheets 102, 104 are sealed together to form bottom seal 106, side seals 108, 110 and top seal 112. Seals 106, 108, 110 and 112 are typically hard seals, with access to variable alignment slider zipper 10 being provided by tear lines 114, 116, typically formed by perforation or scoring, in front and rear web sheets 102, 104, respectively.

Variable alignment slider zipper 10 extends from side to side, downwardly adjacent from top seal 112. Endstops 118, 120 are formed at the ends of variable alignment slider zipper 10. Variable alignment slider zipper 10 further includes male profile interlocking profile 16 with flange 22 and female interlocking profile 20 with flange 37. Flanges 22 and 37 are sealed to front and rear webs 102, 104 along seal bands 122, 124 formed below tear lines 114, 116 whereby a portion of front and rear web sheets 102, 104 extends above and over variable alignment slider zipper 10 thereby forming a tear away header 125. Additionally, the distal ends 126, 128 of flanges 22, 37 are typically sealed together with a frangible tamper-evident seal 130. Alternative embodiments may eliminate the frangible tamper-evident seal 130. Likewise, in alternate embodiments, the front and rear webs 102, 104 would not extend beyond seal bands 122, 124, thereby resulting in an embodiment without the tear away header 125, and eliminate the need for tear lines 114, 116 or top seal 112. Further alternative embodiments could substitute a fold in a single web sheet for the top seal 112 between two web sheets 102, 104.

In fact, those skilled in the art, after review of the present disclosure, will realize that the variable alignment slider zipper 10 can be implemented on many different embodiments and configurations of reclosable bags. Similarly, the reclosable bag 100 may be manufactured as an empty consumer bag or may be manufactured and filled with a product in a form fill and seal process such as disclosed in, for instance, U.S. Pat. No. 4,894,975 entitled "Method and Apparatus for Making Reclosable Bags with Fastener Strips in a Form Fill and Seal Machine", issued on Jan. 23, 1990 to Ausnit; U.S. Pat. No. 6,138,439 entitled "Methods of Making Slide-Zippered Reclosable Packages on Horizontal Form-Fill-Seal Machines", issued on Oct. 31, 2000 to McMahon et al.; and U.S. Pat. No. 6,178,722 entitled "Application System for Sliders at Form-Fill-Seal Machine", issued on Jan. 30, 2001 to McMahon, the contents of all of which are hereby incorporated by reference.

Figure 3:
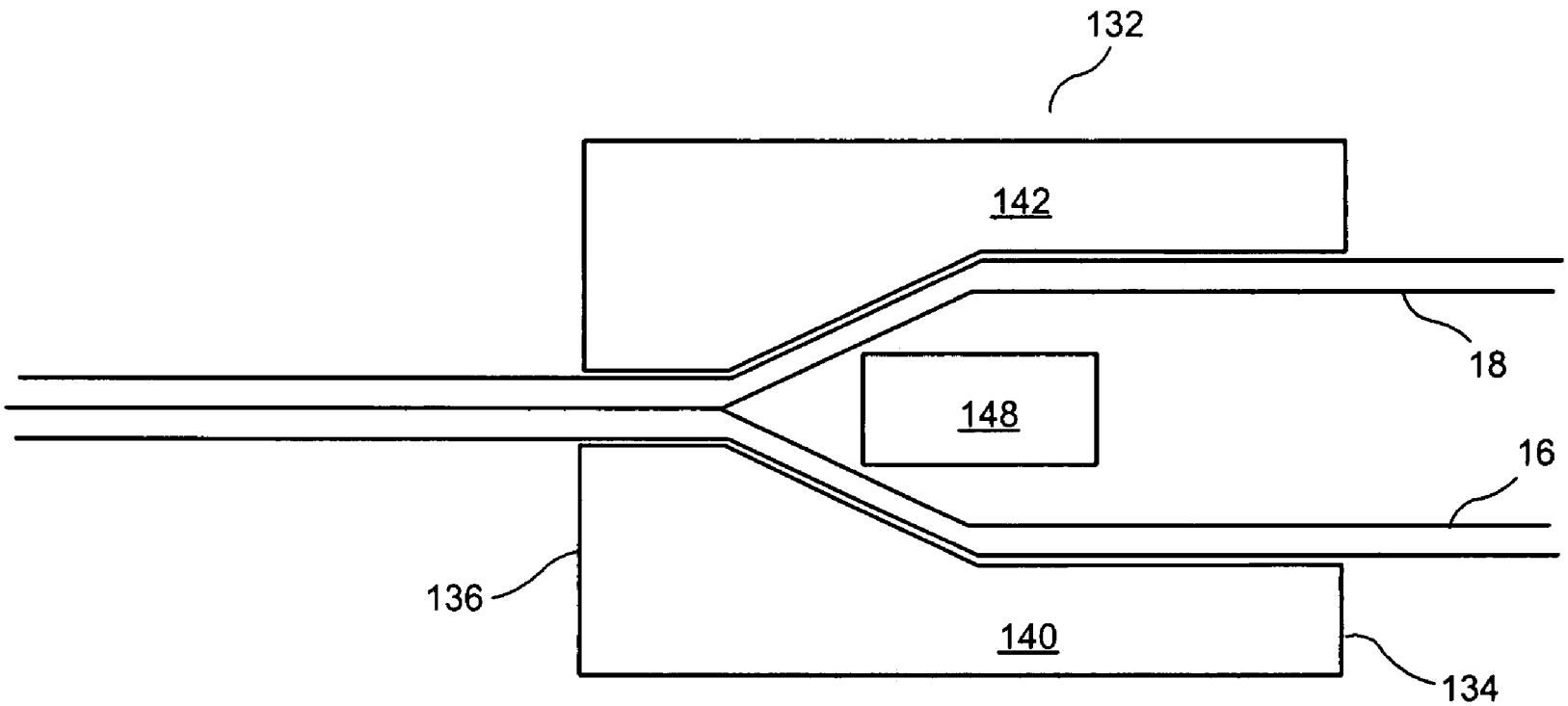
FIG. 3 is a cross-sectional view along plane 3-3 of FIG. 2.

Slider 132 is mounted on variable alignment slider zipper 10. Slider 132 has an opening end 134 and a closing end 136 (see FIG. 3). Slider 132 includes top wall 138, with side walls 140, 142 terminating in inwardly extending flanges 144, 146, respectively. There is sufficient distance between top wall 138 and inwardly extending flanges 144, 146 to accommodate the various alignments illustrated in FIGS. 4-7. Slider 132 opens variable alignment slider zipper 10 by being pushed in an opening direction (in an opposite direction from opening end 134), thereby forcing slider plow 148 (see FIG. 3) between zipper profiles 16, 20, and closes variable alignment slider zipper 10 by being pushed in a closing direction (in an opposite direction from closing end 136), opposite to the opening direction, as would be known to a person skilled in the art after review of the present disclosure.

Figure 8:
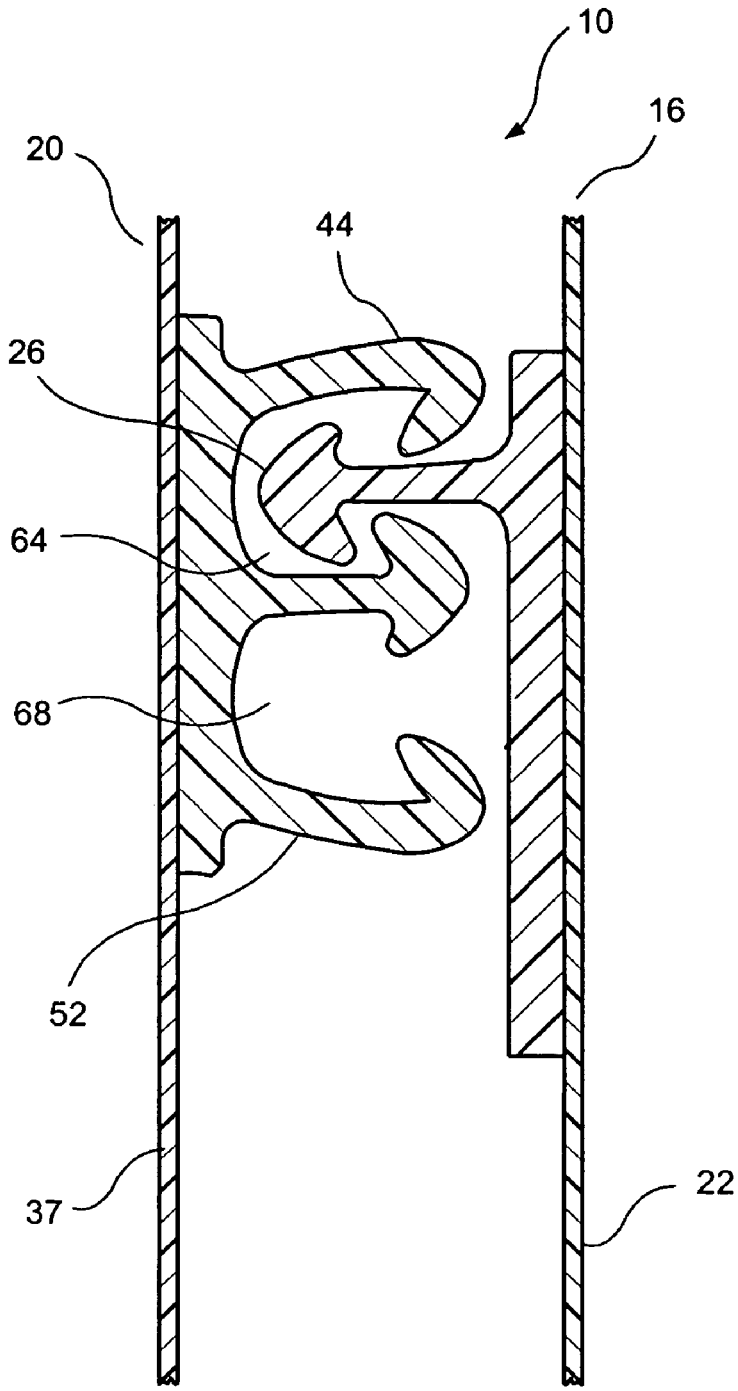
FIG. 8 is a cross-sectional view of a first alternative embodiment of the variable alignment zipper of the present invention with the view taken from reference line 4-4 of FIG. 1.
Figure 9:
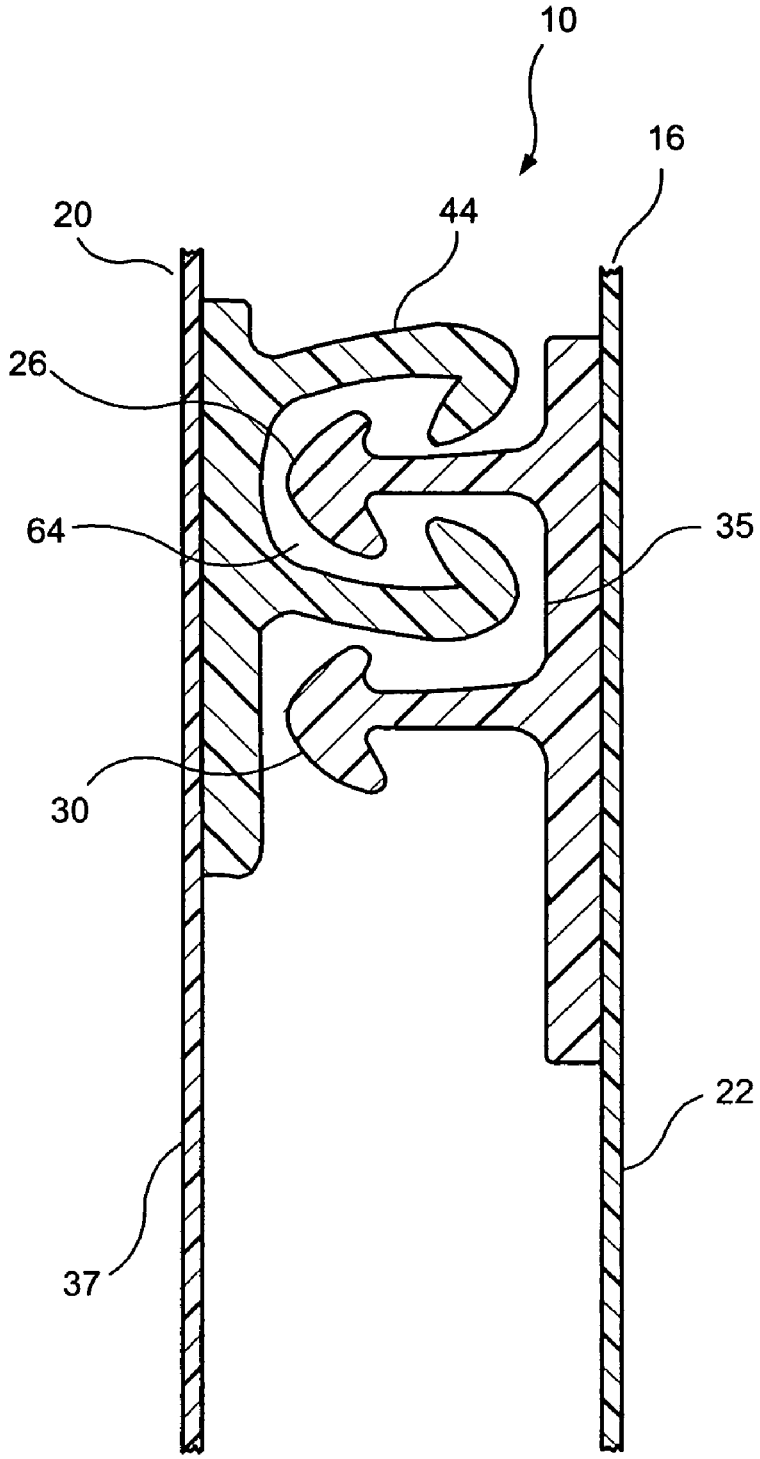
FIG. 9 is a cross-sectional view of a second alternative embodiment of the variable alignment zipper of the present invention with the view taken from reference line 4-4 of FIG. 1.

FIGS. 4-7 disclose the structure of the zipper profiles 16, 20 and illustrate the variable alignment characteristics of variable alignment slider zipper 10. These figures disclose an embodiment with three ribs on each zipper profile 16, 20. However, it envisioned that the variable alignment capabilities of the present invention could similarly be achieved with different embodiments. For instance, a configuration with three ribs on one profile and one rib on a second profile such as shown in FIG. 8 or a configuration with two ribs on each profile such as shown in FIG. 9 would likewise achieve the variable alignment capabilities. Those skilled in the art, after review of the present disclosure, will recognize a broad range of equivalents.

Figure 4:
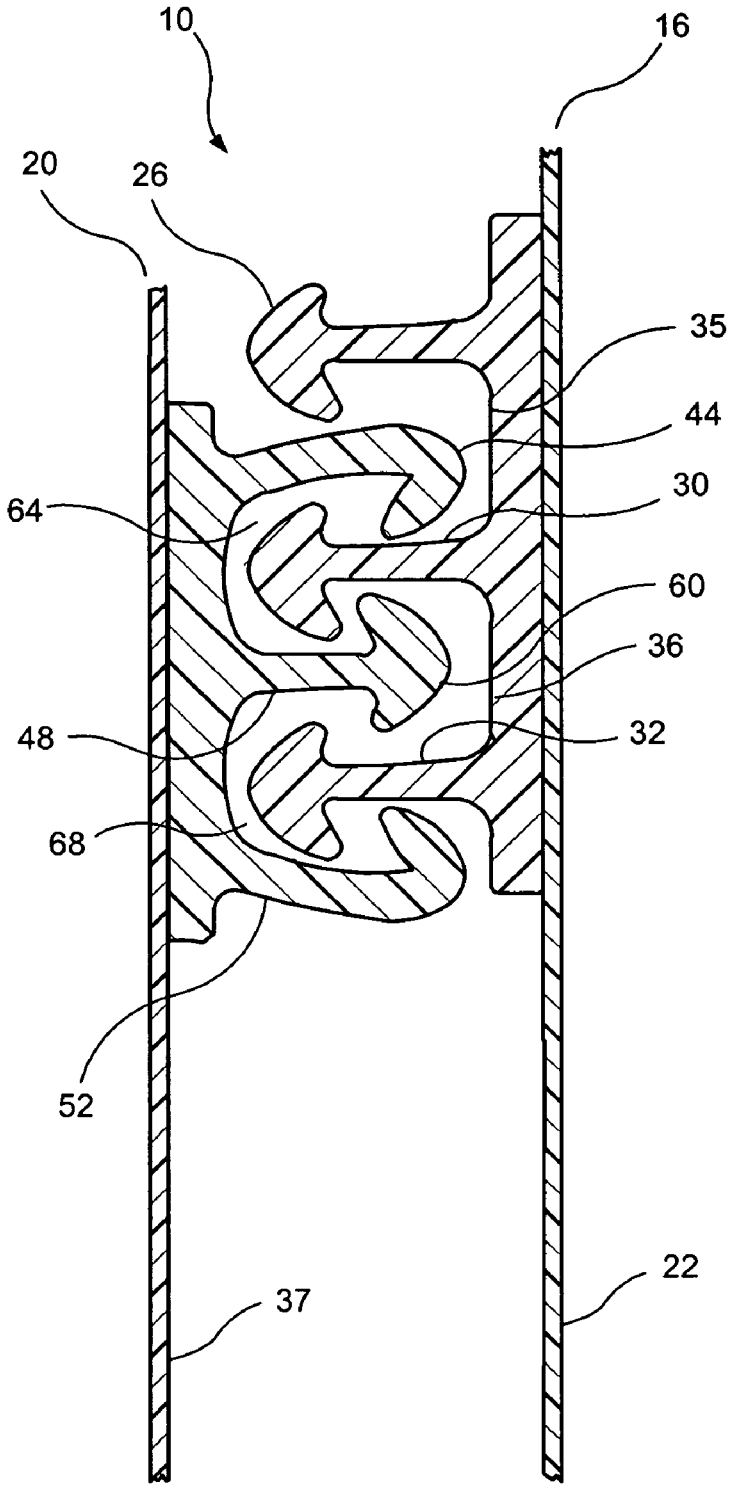
FIG. 4 is a cross-sectional view of the variable alignment zipper of the present invention in a first engagement and with the view taken from reference line 4-4 of FIG. 1.

In FIG. 4, the male interlocking profile 16 is interlocked with the female interlocking profile 20 in a first engagement of the variable alignment slider zipper 10. The male interlocking profile 16 is a resiliently flexible profile with flange 22. The male interlocking profile 16 includes three male ribs 26, 30, 32, with each of the male ribs having double-barbed end sections. The bordering of the male ribs 26, 30, 32 creates grooves (or sockets) 35 and 36. The number and shape of the ribs can vary based on factors known to those skilled in the art.

The female interlocking profile 20 is a resiliently flexible profile opposite and facing the male interlocking profile 16. The female interlocking profile 20 includes flange 37. The female interlocking profile 20 includes three male ribs 44, 48 and 52. The male ribs 44 and 52 are each formed with a single-barbed end section. The single-barbed end sections of the male ribs 44, 52 extend laterally to the third male rib 48. The male rib 48 has a double-barbed end section 60. The bordering of the male ribs 44 and 52 to the male rib 48 creates grooves (or sockets) 64 and 68. The number and shape of the ribs can vary based on factors known to those skilled in the art.

For interlocking the male interlocking profile 16 and the female interlocking profile 20 in the first engagement of the variable alignment slider zipper 10, the profiles are pressed together. In the first engagement, a first male rib of the male interlocking profile 16 secures to a first groove of the female interlocking profile 20. As shown, the male rib 26 sizably conforms to the groove 68 with the male rib 26 adequately secured by an integral double-barbed end section. With a single-barbed end section on the male rib 52 of the female interlocking profile 20, the male rib 52 slides into the groove 35 with less resistance to and movement of the male rib 30 than if the male rib 52 had a double-barbed end section.

The male interlocking profile 16 and the female interlocking profile 20 are adapted to be separated by pulling them apart thereby breaking the interlocking relationship of the male rib 26 with the groove 68. Similar to the closing operation, the single-barbed male rib 52 would encounter less resistance from the male rib 30 as the profiles are being pulled apart than if the male rib 52 had a double-barbed end section. For the other three interlocking engagements described below, the male and female interlocking profiles are similarly pulled apart in order to separate the profiles from one another.

Figure 5:
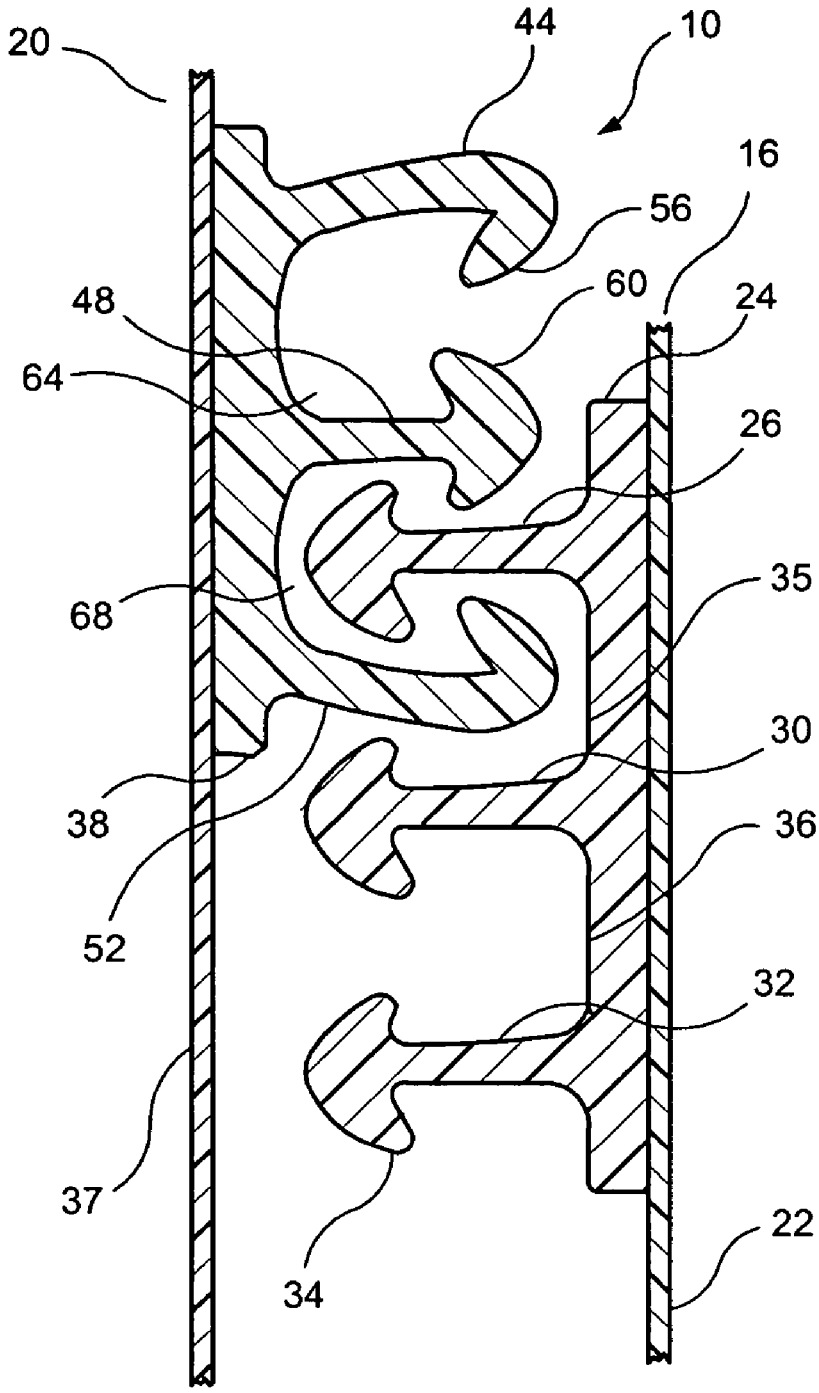
FIG. 5 is a cross-sectional view of the variable alignment zipper of the present invention in a second engagement with the view taken from reference line 4-4 of FIG. 1.

For interlocking the male interlocking profile 16 and the female interlocking profile 20 in a second engagement of the variable alignment slider zipper 10 as shown in FIG. 5, the profiles 16, 20 are pressed together. In the second engagement, two male ribs of the male interlocking profile 16 secure to two grooves of the female interlocking profile 20. As shown in FIG. 5, the male ribs 26 and 30 sizably conform to the grooves 64 and 68 respectively. Both male ribs 26 and 30 are adequately secured to the female interlocking profile 20 by an integral double-barbed end section for each male rib. With a single-barbed end section on the male rib 52 of the female interlocking profile 20, the male rib 52 slides into the groove 36 with less resistance to and movement of the male rib 32 than if the male rib 52 had a double-barbed end section. Similar to the closing operation, the single-barbed male rib 52 would encounter less resistance from the male rib 32 as the profiles are being pulled apart than if the male rib 52 had a double-barbed end section.

Figure 6:
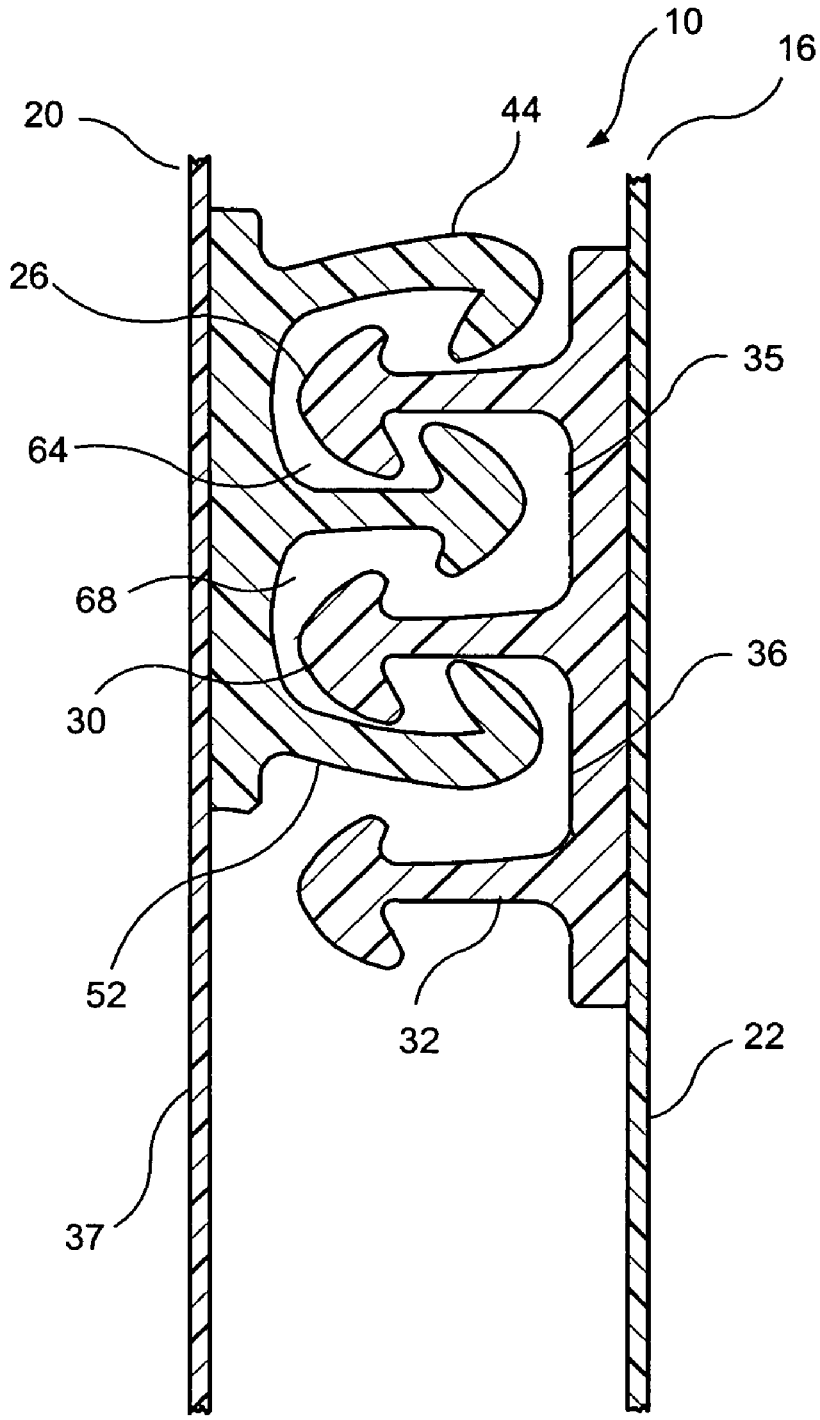
FIG. 6 is a cross-sectional view of the variable alignment zipper of the present invention in a third engagement and with the view taken from reference line 4-4 of FIG. 1.

For interlocking the male interlocking profile 16 and the female interlocking profile 20 in a third engagement of the variable alignment slider zipper 10 as shown in FIG. 6, the profiles 16, 20 are pressed together. In the third engagement, two male ribs of the male interlocking profile 16 secure to two grooves of the female interlocking profile 20. As shown in FIG. 6, the male ribs 30 and 32 sizably conform to the grooves 64 and 68 respectively. Both the male ribs 30 and 32 are adequately secured to the female interlocking profile 20 by an integral double-barbed end section for each male rib. With a single-barbed end section on the male rib 44 of the female interlocking profile 20, the male rib 44 slides into the groove 35 with less resistance to and movement of the male rib 26 than if the male rib 44 had a double-barbed end section.

Similar to the closing operation, the single-barbed male rib 44 would encounter less resistance from the male rib 26 as the profiles are being pulled apart than if the male rib 44 had a double-barbed end section.

Figure 7:
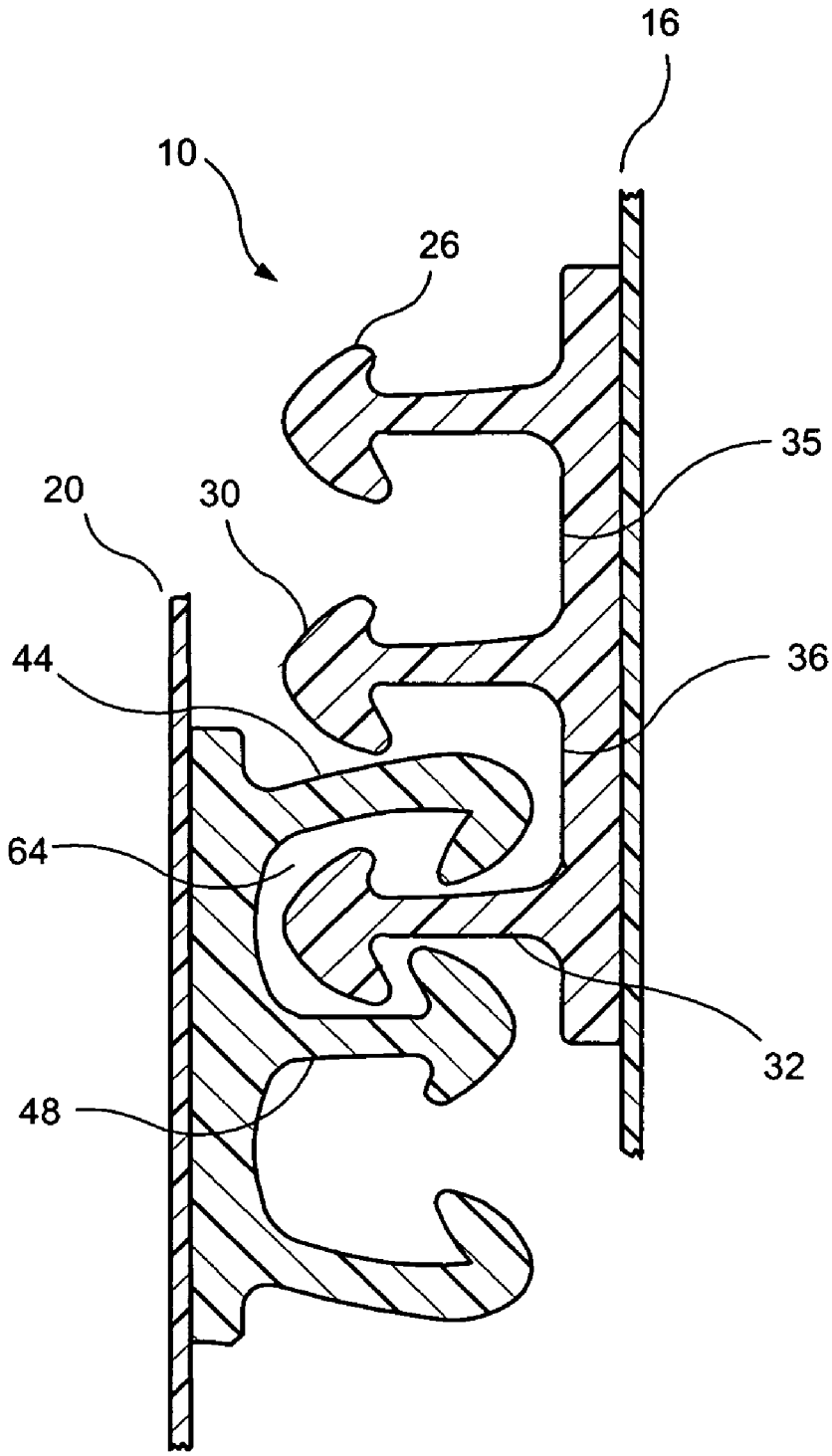
FIG. 7 is a cross-sectional view of the variable alignment zipper of the present invention in a fourth engagement and with the view taken from reference line 4-4 of FIG. 1.

For interlocking the male interlocking profile 16 and the female interlocking profile 20 in a fourth engagement of the variable alignment slider zipper 10 as shown in FIG. 7, the profiles 16, 20 are pressed together. In the fourth engagement, a male rib of the male interlocking profile 16 secures to a groove of the female interlocking profile 20. As shown in FIG. 7, the male rib 32 sizably conforms to the groove 64. The male rib 32 is adequately secured to the female interlocking profile 20 by an integral double-barbed end section. With a single-barbed end section on the male rib 44 of the female interlocking profile 20, the male rib 44 slides into the groove 36 with less resistance to and movement of the male rib 30 than if the male rib 44 had a double-barbed end section. Similar to the closing operation, the single-barbed male rib 44 would encounter less resistance from the male rib 30 as the profiles are being pulled apart than if the male rib 44 had a double-barbed end section.

The resulting configuration allows simple and reliable alignment and interlocking of profiles 16, 20 in the manufacturing process and subsequently provides for smooth operation and a balanced tactile feel on the part of the consumer.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable bag including a front web wall and a rear web wall, with a mouth formed therebetween, and further including a reclosable zipper adjacent to said mouth, said reclosable zipper including a first profile and a second profile, wherein said first profile includes a first set of at least three interlocking ribs and said second profile includes a second set of at least three interlocking ribs, whereby said first set of interlocking ribs can interlock with said second set of interlocking ribs in a plurality of alignments, said zipper further including a slider for interlocking and separating said first profile with respect to said second profile.

2. The reclosable bag of claim 1 wherein said first set includes a first peripheral interlocking rib, a second peripheral interlocking rib, and one and only one central rib between said first and second peripheral interlocking ribs.

3. The reclosable bag of claim 2 wherein said second set includes a third peripheral interlocking rib, a fourth peripheral interlocking rib, and one and only one intermediate rib between said third and fourth peripheral interlocking ribs.

4. The reclosable bag of claim 3 wherein said first and second peripheral interlocking ribs each terminate in two barbs.

5. The reclosable bag of claim 4 wherein a first of said two barbs on each of said first and second peripheral interlocking ribs is on a side of said peripheral interlocking ribs facing toward said central interlocking rib and a second of said two barbs on each of said first and second peripheral interlocking ribs is on a side of said peripheral interlocking ribs facing away from said central interlocking rib.

6. The reclosable bag of claim 5 wherein said third and fourth interlocking ribs each terminate in a single barb.

7. The reclosable of claim 6 wherein said single barbs on said third and fourth interlocking ribs face toward said intermediate rib.

8. The reclosable bag of claim 2 wherein said first and second profiles include respective first and second flanges, said first and second flanges being sealed to said front and rear walls along first and second seal areas, respectively.

9. The reclosable bag of claim 8 wherein said front and rear walls extend beyond said first and second seal areas to form a header over said zipper.

10. The reclosable bag of claim 9 wherein at least one of said front and rear walls include a tear line beyond said first and second seal areas in order to provide access to said zipper through said header.

11. The reclosable bag of claim 9 wherein said front and rear walls each include a tear line beyond said first and second seal area thereby allowing said header to be tom from said reclosable bag to provide access to said zipper.

12. The reclosable bag of claim 2 wherein distal ends of said first and second flanges have a frangible seal formed therebetween.

13. The reclosable bag of claim 12 wherein said frangible seal is tamper-evident.

14. A reclosable bag including a front web wall and a rear web wall, with a mouth formed therebetween, and further including a reclosable zipper adjacent to said mouth, said reclosable zipper including a first profile and a second profile, wherein said first profile includes an interlocking rib and said second profile includes a plurality of sockets, whereby said interlocking rib can interlock with said plurality of sockets in a plurality of alignments, said zipper further including a slider for interlocking and separating said first profile with respect to said second profile.

15. The reclosable bag of claim 14 wherein said first and second profiles include respective first and second flanges, said first and second flanges being sealed to said front and rear walls along first and second seal areas, respectively.

16. The reclosable bag of claim 15 wherein said front and rear walls extend beyond said first and second seal areas to form a header over said zipper.

17. The reclosable bag of claim 16 wherein at least one of said front and rear walls include a tear line beyond said first and second seal areas in order to provide access to said zipper through said header.

18. The reclosable bag of claim 16 wherein said front and rear walls each include a tear line beyond said first and second seal area thereby allowing said header to be torn from said reclosable bag to provide access to said zipper.

19. A reclosable bag including a front web wall and a rear web wall, with a mouth formed therebetween, and further including a reclosable zipper adjacent to said mouth, said reclosable zipper including a first profile and a second profile, wherein said first profile includes a first interlocking mechanism and said second profile includes a second interlocking mechanism, whereby said first interlocking mechanism can interlock with said second interlocking mechanism in a plurality of alignments, said zipper further including a slider for interlocking and separating said first profile with respect to said second profile.

20. The reclosable bag of claim 19 wherein said first and second profiles include respective first and second flanges, said first and second flanges being sealed to said front and rear walls along first and second seal areas, respectively.

* * * * *